United States Patent [19]

Dunsmoor

[11] 4,301,622

[45] Nov. 24, 1981

[54] CASEMENT WINDOW OPERATING MECHANISM

[75] Inventor: Forrest L. Dunsmoor, Atlanta, Ga.

[73] Assignee: Peachtree Doors, Inc., Norcross, Ga.

[21] Appl. No.: 163,698

[22] Filed: Jun. 27, 1980

[51] Int. Cl.[3] ..... E05F 11/24

[52] U.S. Cl. ..... 49/342; 49/249; 49/260; 49/345

[58] Field of Search ..... 49/342, 345, 324, 260, 49/246, 248, 249, 250, 252, 253

[56] References Cited

U.S. PATENT DOCUMENTS 3,438,151 4/1969 Evers et al. ..... 49/345

4,241,541 12/1980 Van Klompenburg et al. ..... 49/342 X

*Primary Examiner*—Philip C. Kannan

*Attorney, Agent, or Firm*—D. Paul Weaver

[57] ABSTRACT

Right and left hand casement windows employ a simple and compact operating linkage which can be installed either to the right or to the left of a center mounted gear drive, thus accomplishing universal operation of left or right hand windows through a structurally identical linkage. Locking tabs provided on an operator link of the mechanism coact in right or left hand mode of operation with locking projections on a stabilizer link to assure positive and secure closing of the window even in cases where the primary jamb-mounted window sash latch is unfastened.

8 Claims, 16 Drawing Figures

CASEMENT WINDOW OPERATING MECHANISM

BACKGROUND OF THE INVENTION

Operating mechanisms for casement windows or like swinging closures are known in the prior art in many forms, and these mechanisms vary in comparative simplicity and cost, strength and convenience of operation. Commonly, casement window operating mechanisms are not universal in the sense that right and left hand window sashes require the use of non-identical right and left hand operating mechanisms, which obviously increases the cost of window installation.

One of the objectives of this invention is, therefore, to provide practical, convenient, compact, sturdy and economical operating mechanism for casement windows which is universal or non-handed.

The prior art also teaches numerous locking arrangements for casement windows many of which are separate from the sash operating mechanism and therefore do not come into play automatically when the sash moves to a closed position. At least one prior United States patent, namely U.S. Pat. No. 3,438,151, issued to Evers, discloses a locking arrangement which includes a component carried by the sash and a coacting component carried by the sash operating linkage or mechanism which is not universal. This requires not only right and left hand sash operating mechanisms but right and left hand locking components on the sash and mechanism which engage automatically when the casement window is closed.

A further important object of this invention is to improve on the locking arrangement in the above-noted Evers et al. patent by providing directly in the universal or non-handed sash operating mechanism interengaging locking elements which come into play automatically to securely lock the sash regardless of whether a right or left hand installation is involved.

Additional features of the invention reside in the provision of a highly compact, smooth-acting and durable mechanism which is easy to operate and offers a high mechanical advantage during the final sash closing movement where resistance forces impeding closing are the greatest.

Other features and advantages of the invention will become apparent during the course of the following description.

DETAILED DESCRIPTION

Figure 1:
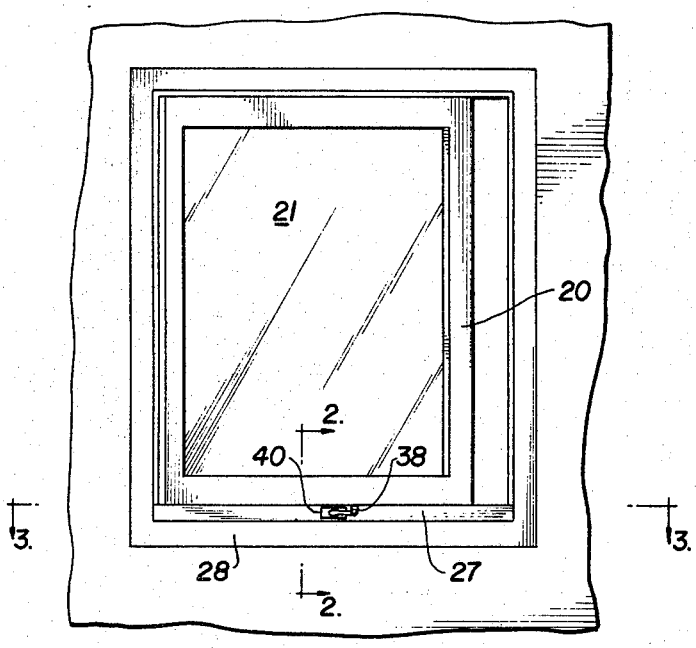
FIG. 1 is a side elevation showing the interior side of a casement window equipped with operating mechanism embodying the invention.
Figure 2:
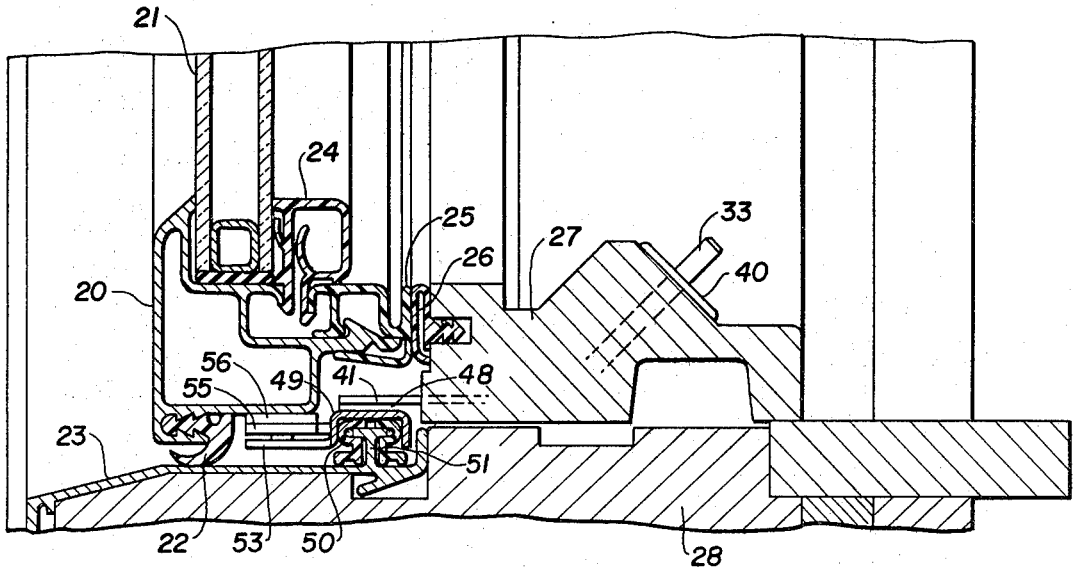
FIG. 2 is an enlarged fragmentary vertical section taken on line 2—2 of FIG. 1.

Referring to the drawings in detail wherein like numerals designate like parts, a casement window shown in FIGS. 1 and 2 comprises an aluminum sash frame 20 having an insulating glass pane 21. The sash frame 20 carries a vinyl exterior perimeter seal 22, the bottom portion of which engages an exterior aluminum sill 23 when the casement window is closed. A glass back-up member 24 on the sash frame 20 is coupled with a seating member 25 which engages a vinyl or other rubber-like interior perimeter seal 26 when the window is closed, the seal 26 being carried by an interior sill cover member 27 atop the wooden sill 28. The construction, as described thus far, is substantially conventional. The invention proper, now to be described, pertains to a linkage or mechanism for opening and closing the casement window and for automatically locking it whenever the window sash is swung to the closed position.

Continuing to refer to the drawings, the operating linkage or mechanism comprises an operating arm 29 integrally attached to a sector gear 30 whose gear teeth span an arc of approximately 180 degrees. The sector gear teeth 31 are in mesh with an inclined worm gear 32 carried by a drive shaft 33 which is suitably held in an inclined extension 34 of a rigid mounting bracket 35 secured by screws 36 to the sill cover member 27. The sector gear 30 is rotatably attached to mounting bracket 35 by a rivet 37 or the like. The shaft 33 is turned by a crank handle 38 coupled with splines 39 on the shaft 33, a suitable escutcheon plate 40 being provided as shown in the drawings.

Figure 3:
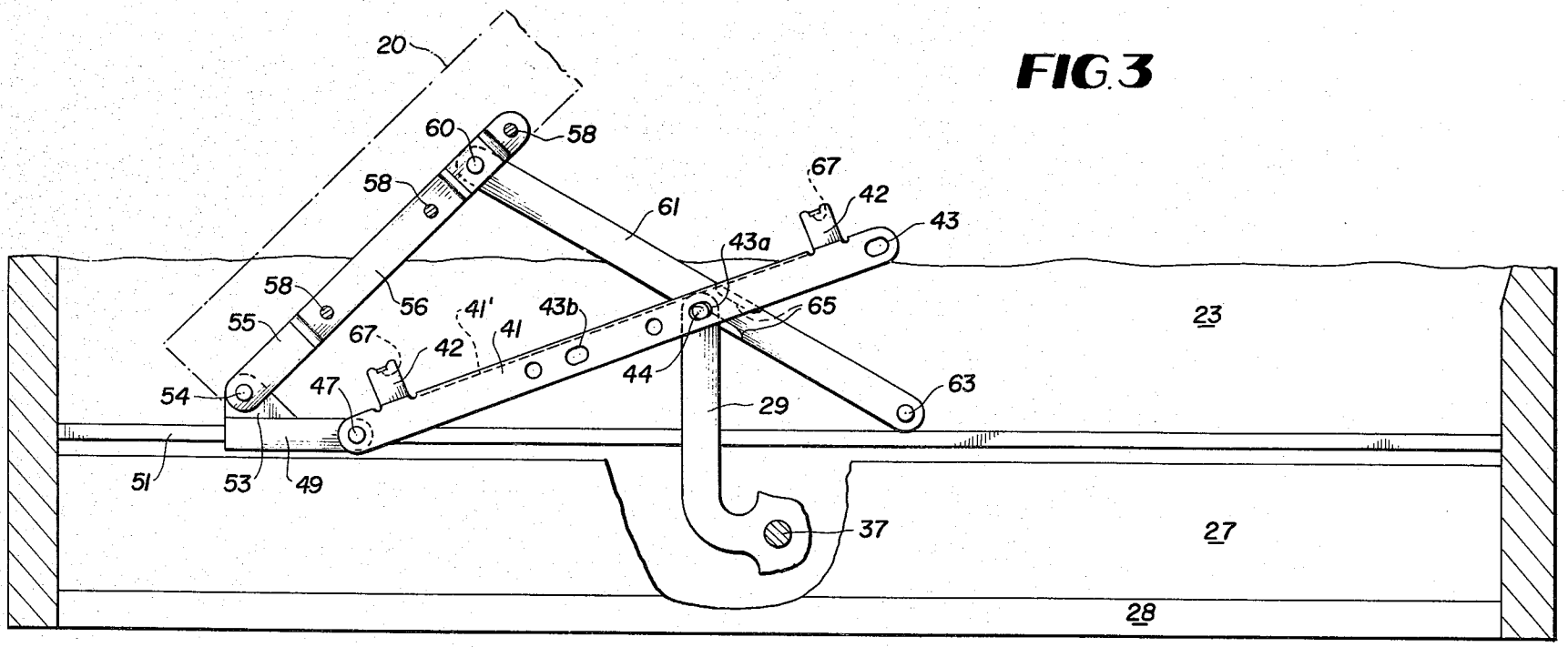
FIG. 3 is an enlarged horizontal section taken on line 3—3 of FIG. 1 and showing the window in a partly open position.
Figure 4:
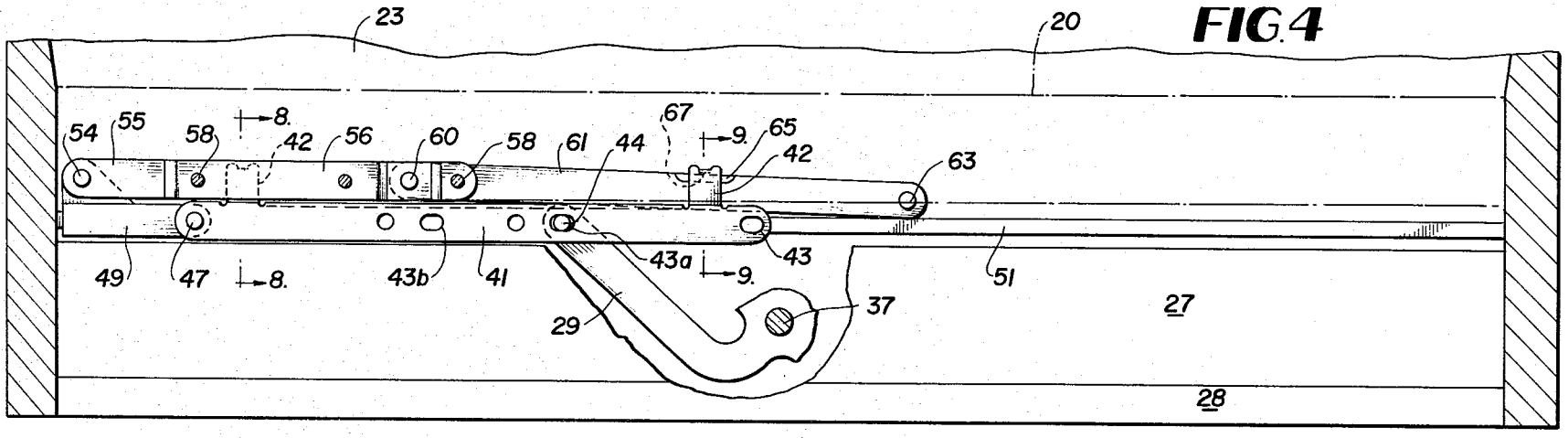
FIG. 4 is a similar view showing the window closed and locked in accordance with the invention.
Figures 5, 6, 7, 8, 9, 10:
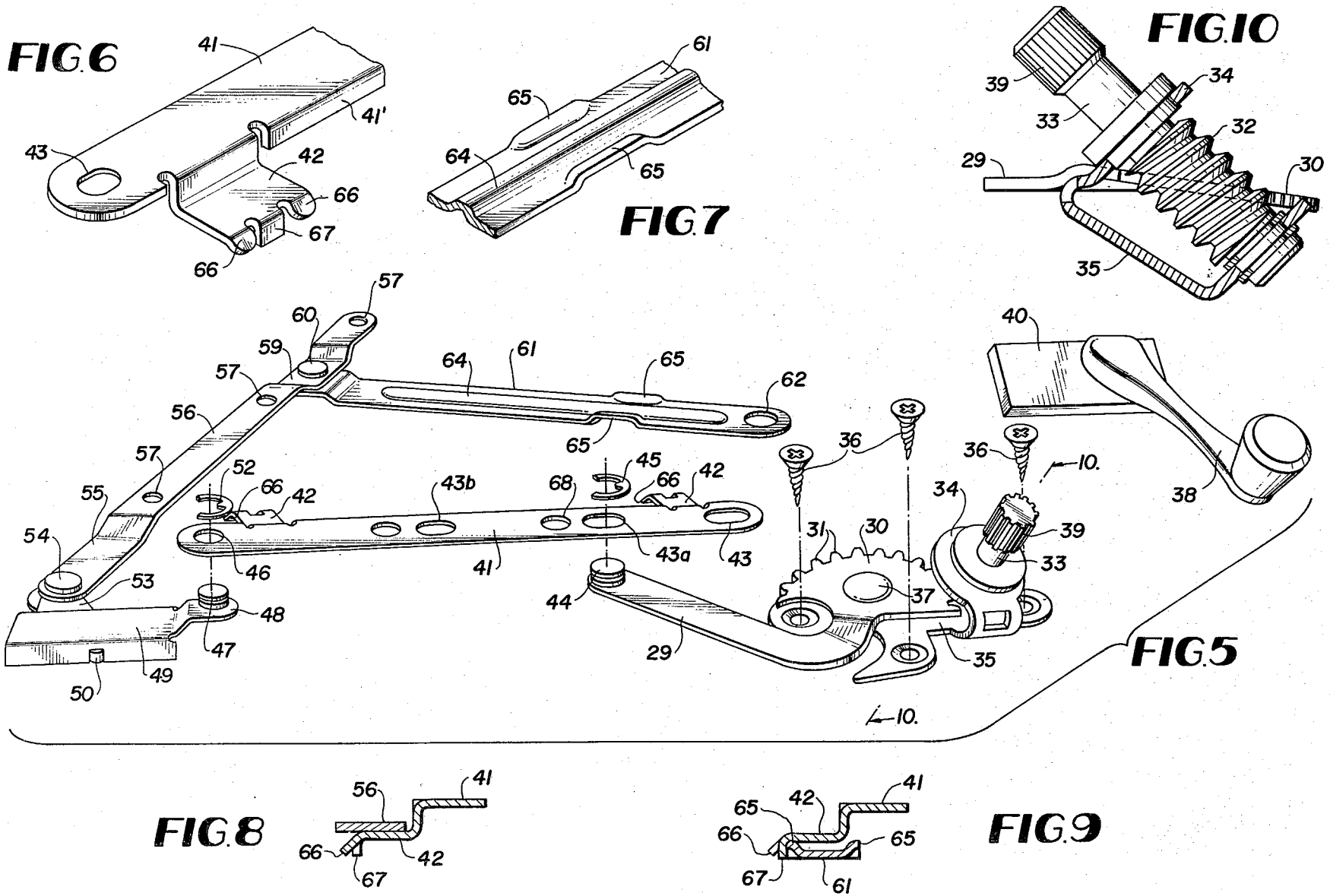
FIG. 5 is an exploded perspective view of a window operating and locking mechanism embodied in the invention.
FIG. 6 is a fragmentary perspective view of an operator link and attached window locking tab.
FIG. 7 is a fragmentary perspective view of a coacting stabilizer link having locking projections.
FIG. 8 is an enlarged fragmentary vertical section taken on line 8—8 of FIG. 4.
FIG. 9 is a similar view taken on line 9—9 of FIG. 4.
FIG. 10 is a side elevation of a gear operator taken in the plane of line 10—10 of FIG. 5.
Figure 12:
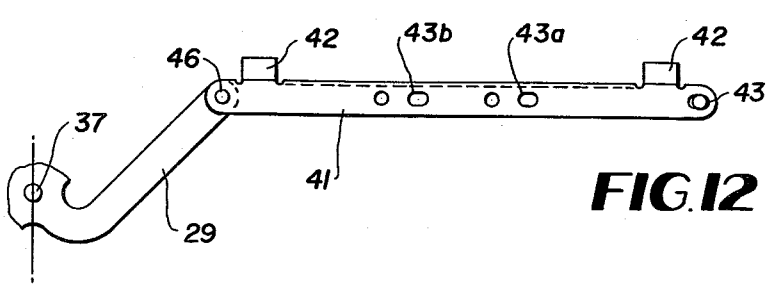
FIGS. 11 through 16 are partly diagrammatic plan views showing left and right hand operating mechanisms for windows of three different widths.
Figure 11:
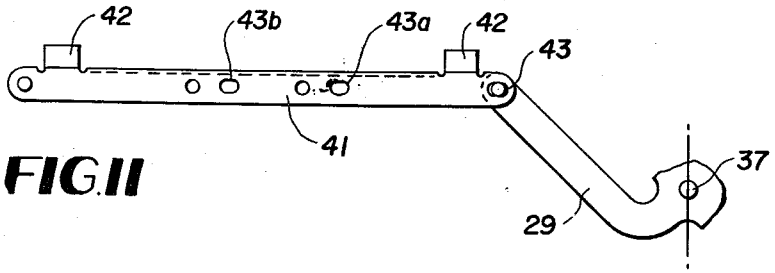
Figure 14:
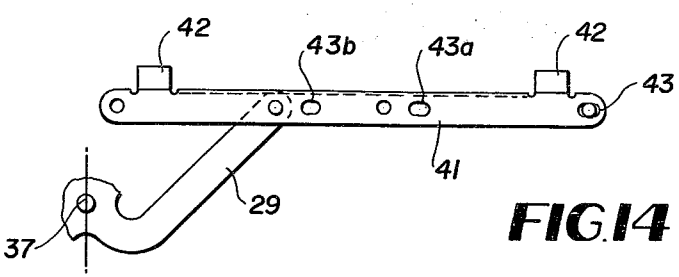
Figure 13:
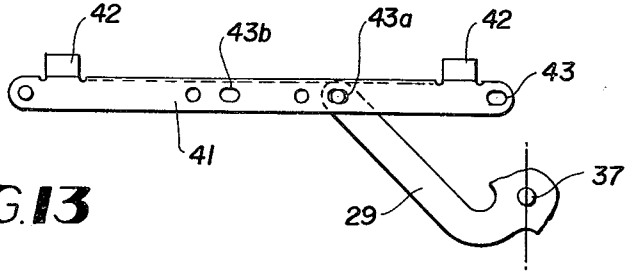
Figure 16:
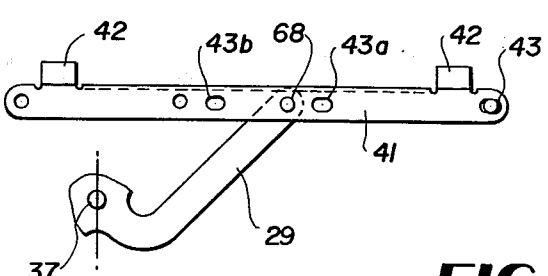
Figure 15:
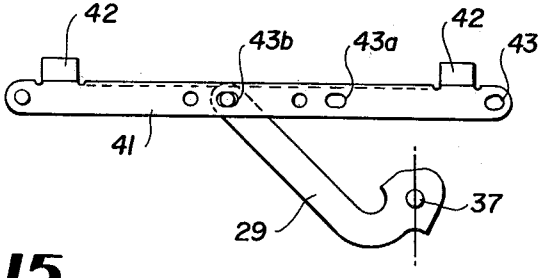

The mechanism further comprises an operator line 41 provided along one longitudinal edge and near its opposite ends with substantially rigid locking extension plates 42 forming key elements of the invention, to be further described. The operator link 41 has three spaced slots 43, **43*a* and 43*b* formed therethrough to render the mechanism compatible with casement windows of three different widths, such as 30 inches wide, 24 inches wide, and 20 inches wide. The slot 43, FIGS. 11 and 12, is employed for left and right hand 30 inch windows, the intermediate slot 43*a*, FIGS. 13 and 14, is employed for left and right hand 24 inch windows, and the slot 43*b*, FIGS. 15 and 16, is employed for left and right hand 20 inch windows, as will be further discussed. FIGS. 3, 4 and 5 of the drawings show a left hand (as viewed from the inside of the window) 24 inch wide casement window installation wherein the intermediate slot 43*a* of operator link 41 is pivotally engaged with the upstanding stud 44 on the end of the arm 29 driven by sector gear 30. A resilient E-ring 45 is utilized to maintain the link 41 pivotally assembled with the stud 44. The link 41 also preferably has a longitudinal stiffening flange 41'**, as shown. All following references to right or left handedness are made in the sense of viewing the interior of the window.

The far end of operator link 41 has an opening 46 pivotally coupled with an upstanding stud 47 carried by an elevated plate extension 48 of a slide 49. The slide 49 has a low friction liner 50 of dry lube material slidably engaging a T-track 51 rigid with the aluminum sill 23 and extending horizontally across the bottom of the window opening. Another E-ring 52 maintains operator link 41 coupled with the stud 47 of the slide.

The slide 49 carries an outer side plate extension 53 having a pivot element 54 with which one depressed end 55 of a pivot arm or link 56 is pivotally coupled. The pivot link 56 has three longitudinally spaced openings 57 allowing it to be firmly attached to the bottom edge of sash frame 20 by suitable fasteners 58, FIG. 3. Near its far end, the pivot link 56 has a depressed portion 59 coupled through a pivot element 60 or rivet with a stabilizer link 61 also forming a key element of the invention and comprising the final component of the linkage. The stabilizer link 61 has an aperture 62 formed therethrough enabling the stabilizer link to be pivoted at its far end through a pivot element 63 to an appropriate point on the window sill 23. The pivot element 63 is fixed in relation to the window sill. The link 61 has a longitudinal rib 64 for increased rigidity and is provided at an intermediate point along its length and on opposite sides with a pair of raised locking projections 65 or elements.

Each aforementioned locking extension plate 42 on the operator link 41 is depressed from the plane of the link 41, as best shown in FIG. 6. Each extension plate 42 carries a pair of inclined camming tongues 66 intervened by a depending right angular locking tongue 67. When the crank handle 38 is operated in the proper direction for closing the left hand casement window shown in FIGS. 1, 3 and 4, the arm 29 swings counterclockwise toward its position in FIG. 4 and draws the operator link 41 with it toward a position where the operator link becomes parallel to the closed window sash, or sash frame 20. The slide 49 travels outwardly toward one end of the T-track 51 to enable this closing movement of the operator link 41.

Simultaneously, as the slide 49 travels to its position of FIG. 4, the toggle formed by pivot link 56 and stabilizer link 61 is flattened out until these two links are in a near dead center relationship, FIG. 4, relative to their pivots 54 and 63 and lie roughly parallel to the operator link 41 and slide 49. During this collapsing of the operating linkage from the position of FIG. 3 to the position of FIG. 4, the casement window is swung from a partly open or full open position to a closed position. As this movement takes place, the depending locking tongue 67 on extension plate 42 nearest the slot 43 and pivot 63 gradually moves into contact with the outermost opposing raised locking projection 65 of stabilizer link 61. This contact occurs near the end of travel of the two links 41 and 61 toward their positions of FIG. 4 and hence the locking tongue 67 will help to force the stabilizer link home to the window closing position and will also positively lock the window operating linkage in its collapsed position of FIG. 4 so that the window cannot be pried open without destroying the operating linkage, even in cases where the primary window latch, not shown, remains disengaged. FIG. 9 clearly shows the engaged relationship of the locking tongue on extension plate 42 of link 41 with the outside locking projection 65 of stabilizer link 61.

While the above window closing and automatic locking action is taking place, FIGS. 3 and 4, the extension plate 42 nearest the slide 49 merely slides beneath the pivot link 56, and the inclined tongues 66 can exert a camming action upwardly on the pivot link 56 to avoid any binding of the operating linkage when the casement window is being closed. The relationship of the links 41 and 56 to each other and to the camming tongues 66 when the window is closed is clearly shown in FIG. 8.

All of the above relates to a left hand casememt window of intermediate width, such as 24 inches wide, as previously explained. In the case of a right hand casement window of the same width, FIG. 14, the arm 29 and its pivot 37 remain in the same position, namely, at the transverse center of the window and the identical linkage can be employed on the right hand side of the center pivot 37 to operate and automatically lock a right hand casement window. In this right hand mode, the action of the two extension plates 42 and their tongues 66 and 67 is reversed in the sense that the locking tongue 67 toward the left hand end of operator link 41 actively engages the opposing projection 65 to lock the right hand window and the camming tongues 66 of the right hand extension plate 42 then slide under pivot link 56 at the bottom of the right hand window sash. This is the reverse of the arrangement described relative to FIGS. 3 and 4. However, no right and left hand linkage components are required and the operating and locking linkage or mechanism is universal and nonhanded in this sense. It should be understood that the same sector gear 30 with approximately 180 degrees of tooth arc is capable of operating either a right hand or left hand casement window sash through a full 90 degree swing from full open to full closed window positions. When fully open, the window sash projects outwardly at 90 degrees to the plane of the wall, FIG. 3 showing an intermediate open position. A different portion of the 180 degree sector gear 30 drives the right hand window sash, not shown. The mounting bracket 35 and shaft 33 remain in the same position at the center of the window at all times.

As noted previously, FIGS. 12 through 16 show that casement windows of three different widths, both right and left hand, can be operated and automatically locked by the identical linkage described above in detail for a left hand window sash of intermediate width, namely 24 inches wide. FIG. 13 corresponds exactly to the arrangement in FIGS. 1 through 5 for a left hand 24 inch wide window. FIG. 14 shows the arrangement for a right hand window installation of the same width. FIGS. 11 and 12 show the arrangement of the elements 29 and 41 for left and right hand 30 inch wide casement windows. In these figures it can be seen that sector gear arm 29 is attached to slot 43 of operator link 41 instead of to intermediate slot **43*a* for the left hand mode and is similarly attached to opening 46 for the right hand mode. In like manner, FIGS. 15 and 16 show the relationship of the parts for left and right hand windows of 20 inch width. The arm 29 is connected to the slot 43*b* of link 41 for left hand installation and is connected to an opening 68 of link 41** for right hand installation.

As shown in FIGS. 11 through 16, the operator link 41 is merely shifted bodily to the right or to the left relative to the axis of shaft 33 for left or right hand window installation and is not inverted. Each casement window sash is manufactured to accept the operating linkage for either right or left hand installation by having openings for the fasteners 58 formed in its top and bottom. Therefore, the window proper is merely inverted top-to-bottom when changing from right hand to left hand installation and vice-versa and the other linkage components including stabilizer link 61 and pivot link 56 are appropriately installed for opposite hand operation.

It should also be noted that in addition to forming an automatic and secure lock for the closed casement window sash, either right or left hand, the locking tongue 67 serves the dual purpose of helping to close the sash by engagement with the stabilizer link 61 during the final few degrees of sash travel toward the closed position of FIG. 4 when the mechanical advantage through the linkage induced by the sector gear 30 is the least. In effect, the activity of the locking tongue 67 boosts the mechanical advantage through the linkage at the most critical time, thus achieving the second major objective of the invention.

In summation, casement window sashes of varying widths can be installed and operated efficiently in either right or left hand mode by the same operating linkage whose drive gear in either instance is located at a fixed point at the center of the window opening. The sector gear 30 has a wide enough expanse of gear teeth, 180 degrees, to operate the linkage and sash in either mode. The unique linkage also has the capability of forming a secure automatic lock for the sash in the fully closed position without the addition of locking attachments to the sash proper, window frame or sill. The locking means is self-contained in the linkage, in contrast to the known prior art. Furthermore, the locking means also serves to boost the linkage during its final few degrees of movement in closing the sash.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. An operating mechanism for casement windows and like swinging closures comprising a drive gear adapted to be mounted centrally of a window opening and having an operating arm which can swing through a sufficient arc of movement to operate a casement window sash in either left hand or right hand mode, an operator link coupled with said operating arm to be shifted thereby and carrying near opposite ends lateral locking projection means, a slide pivotally coupled with one end of the operator link and being engageable with a linear guide at the bottom of the window opening, a pivot link having one end pivotally coupled to said slide and adapted for attachment to the bottom of a casement window sash, and a stabilizer link having one end pivotally coupled to the pivot link near the end of the latter distant from the slide and adapted to have its opposite end pivotally attached to the bottom of the window opening, said locking projection means on one end portion of the operator link moving into engagement with the opposing edge of the stabilizer link during the final stages of window sash closing movement to boost such movement and to automatically lock the sash in the fully closed position.

2. An operating mechanism as defined in claim 1, wherein said drive gear includes a coacting worm gear and gear sector, and the gear sector is attached to said operating arm and has gear teeth spanning an arc of approximately 180 degrees.

3. An operating mechanism as defined in claim 1, and said operator link having plural spaced openings along its length enabling connection of the operator link to said arm at different points along the operator link to accommodate right or left hand operation of casement window sashes of several different widths.

4. An operating mechanism as defined in claim 1, and said lateral locking projection means comprising a depressed plate extension on the operator link near each end thereof projecting horizontally beyond the outer longitudinal edge of the operator link, a depending right angular locking tongue carried by the outer end of each plate extension, and at least one inclined depending camming tongue carried by the outer end of each plate extension on one side of the locking tongue.

5. An operating mechanism as defined in claim 4, and said stabilizer link having raised projections along the opposite longitudinal edges thereof and being disposed on the stabilizer link so that one raised projection is in the path of movement of the depending locking tongue with said operator link.

6. An operating mechanism as defined in claim 1, wherein said stabilizer link and pivot link form with said slide a toggle which collapses into parallel relationship with the linear guide when the casement window sash approaches a fully closed position, and said stabilizer link crossing the operator link in scissoring relationship but being unattached to the operator link and said operating arm.

7. An operating mechanism as defined in claim 1, and said slide comprising a channel member having a dry lube low friction liner, and said linear guide comprising a T-cross section guide track rising from a window sill member, said liner conforming to the cross sectional shape of the T-cross section guide track.

8. An operating mechanism for casement windows and the like comprising a centrally mounted drive gear including a swingable operating arm, an operator link pivotally coupled with the operating arm and having plural longitudinally spaced coupling openings formed therethrough for selective use, locking extensions on one side of the operator link near opposite ends thereof, a toggle linkage including a linear slide pivotally coupled with the operator link and another link adapted for attachment to the casement window sash and a stabilizer link pivotally coupled between the sash and a fixed support, and said locking extension near one end of the operator link moving into engagement with an opposing edge portion of the stabilizer link to lock the casement window sash closed when said toggle linkage is substantially collapsed and substantially parallel to the path of movement of said linear slide.

* * * * *